United States Patent [19]

Oikawa

[11] Patent Number: 4,884,911

[45] Date of Patent: Dec. 5, 1989

[54] MECHANICAL PENCIL WITH LATCHING CHUCK ACTUATOR

[75] Inventor: Hideaki Oikawa, Kasukabe, Japan

[73] Assignee: Pentel Kabushiki Kaisha, Tokyo, Japan

[21] Appl. No.: 263,801

[22] Filed: Oct. 28, 1988

[51] Int. Cl.[4] ..... B43K 21/16; B43K 21/06; B43K 24/04

[52] U.S. Cl. ..... 401/65; 401/83; 401/84

[58] Field of Search ..... 401/53, 55, 62, 67, 401/82-84, 94, 74

[56] References Cited

U.S. PATENT DOCUMENTS 296,302 4/1884 Woodward ..... 401/83 X

FOREIGN PATENT DOCUMENTS 2837586 3/1980 Fed. Rep. of Germany ..... 401/65
62-37757 9/1987 Japan .

*Primary Examiner*—Richard J. Apley
*Assistant Examiner*—David J. Bender
*Attorney, Agent, or Firm*—Wenderoth, Lind & Ponack

[57] ABSTRACT

A mechanical pencil comprising a tubular casing, a centrally apertured conical tip piece connected to an end of the tubular casing to form a pencil tip, a lead engaging chuck device longitudinally movably mounted within the tubular casing, first spring for biasing the chuck device rearwardly relative to the chuck actuator, second spring for biasing the chuck actuator longitudinally forwardly and circumferentially relative to the tubular casing, actuation knob device longitudinally mounted on the tubular casing for rotation the chuck actuator against a resilient force of the second spring, engagement device for slidably engaging the chuck actuator against a resilient force of the second spring, and locking device for locking the chuck actuator to prevent a further rotation of the chuck actuator to thereby release the engagement between the actuation knob and the chuck actuator.

5 Claims, 9 Drawing Sheets

MECHANICAL PENCIL WITH LATCHING CHUCK ACTUATOR

BACKGROUND OF THE INVENTION

The present invention relates to a mechanical pencil having a slidable actuator knob mounted on a tubular casing of the pencil, by which knob a writing lead is advanced when the knob is moved, and more particularly, to a mechanical pencil of the type described above which permits a lead-gripping chuck device to be opened to release its lead-gripping force when it is retracted, and to be closed to firmly hold the lead when same is advanced so that the writing lead can be projected from the tip of the mechanical pencil when the slidable knob is moved.

Generally known mechanical pencil of the type described has two types: one is a pencil in which a chuck device for holding the writing lead is retracted for the purpose of lead-projection, and the other is a pencil in which the chuck device is advanced for the same purpose, and the former type is advantageous in that the writing lead can be used up relatively economically to leave a relatively short remnant lead since it does not need additional space for forward movement of the chuck device, but on the other hand has a serious disadvantage that the writing lead is retracted, although very slightly, when a writing force is added to the lead together with the chuck device.

In view of the disadvantages of the prior art mechanical pencil of the type discribed above, a new mechanical pencil was suggested as disclosed in Japanese Utility Model Publication No. 62-37757, published Sept. 26, 1987 assigned to the present assignee, in which a resilient plate is generally engaged firmly with a tubular casing and disengaged easily with same by a pressure added sidewise by an actuator knob. However, the above described suggestion has another disadvantage that when a relatively high pressure of a writing force is added, the chuck actuator is retracted due to a resiliency of the resilient plate, with the result that the writing lead is retracted also.

SUMMMARY OF THE INVENTION

An object of the present invention is to provide a new mechanical pencil which has a locking device which can reliably receive a writing force and, at the time of lead projection, release the engagement.

Another object of the present invention is to provide an improved mechanical pencil which can prevent as much as possible the retraction of the writing lead by a writing pressure.

A further object of the present invention is to provide a writing instrument by which the writing lead can be used up as long as possible so that a remaining or unusable end portion of the lead is minimun.

Another object of the present invention is to provide an improved mechanical pencil which permits a reliable lead advancing operation by a simple longitudinal movement of an actuator knob.

According to the present invention, there is provided a mechanical pencil comprising a tubular casing, a centrally apertured conical tip piece connected to an end of the tubular casing to form a pencil tip and having a lead retainer for frictionally holding the writing lead therein, a lead engaging chuck device longitudinally movably mounted within said tubular casing, first spring means for biasing the chuck device rearwardly relative to the chuck actuator, second spring means for biasing the chuck actuator forwardly and rotationally relative to the tubular casing, actuation knob means longitudinally mounted on the tubular casing for rotating the chuck actuator against a resilient force of the second spring means, engagement means for slidably engaging the chuck actuator against a resilient force of the second spring means, and locking means for locking the chuck actuator to prevent a further rotation of the chuck actuator to thereby release the engagement between the actuation knob and the chuck actuator.

In the structure described above, when the engagement between the knob and the chuck actuator is released, the chuck device and the chuck actuator are moved rearwardly together with the knob against a resilient force of the second spring means until the chuck contacts a stopper portion of the tubular casing. Thus, a further rearward movement of the knob permits projection of the chuck device forward from the chuck actuator to thereby release a lead gripping force of the chuck device. Thereafter, when a pressure added to the knob is released, the chuck device and the chuck actuator are moved forward by a resilient force of the second spring together with the writing lead, with the result that the lead is projected by a predetermined length from the writing tip of the pencil.

In another embodiment of the present invention, the pencil has a tubular casing, a centrally apertured conical tip piece connected to an end of the tubular casing to form a pencil tip and having a lead retainer for frictionally holding the writing lead therein, a lead engaging chuck device longitudinally movably mounted within the tubular casing to grasp the writing lead, a chuck actuator longitudinally movably mounted within the tubular casing, first spring means for biasing the chuck device rearwardly relative to the chuck actuator, second spring means for biasing the chuck actuator forwardly relative to the tubular casing, a rotary ring rotatably mounted around the chuck actuator. The rotary ring is engageable with the chuck actuator and rotationally spring-biased by the second spring means and has an inclined surface. The pencil comprises further actuation knob means, longitudinally movably mounted on the tubular casing, and coactable with the inclined surface of the rotary ring to release the engagement between the rotary ring and the chuck actuator.

In the another embodiment of the invention described above, when the rotary ring is pivoted by the effect of the actuation knob means against a rotational force of the second spring means, the engagement between the chuck actuator and the rotary ring is released so that the chuck device and the chuck atuator are moved rearwardly together with the knob means against a resilient force of the second spring until the chuck device contacts a stopper portion of the tubular casing. Thus, a further rearward movement of the knob means permits forward projection of the chuck device from the chuck actuator to thereby release a lead gripping force of the chuck device. When the pressure added to the actuation knob is released, the chuck actuator and the chuck device are returned forward to their original positions together with the lead so that the lead projects from the writing tip of the pencil.

BRIEF DESCRIPTION OF THE DRAWINGS

FIG. 1A through FIG. 5B show a first embodiment of the invention, wherein FIGS. 1A, 2A, 3A, 4A, and 5A show a structural feature and operational mode of the mechanical pencil according to the first embodiment of the invention, and FIGS. 1B, 1C, 2B, 3B, 4B and 5B show diagramatically the operation of the major parts and elements of the pencil, FIGS. 8 through 13 show a second embodiment of the invention, wherein FIGS. 8, 10, 11–13 are partly cut-out, partly sectional views showing the operational mode of the pencil.

FIG. 15A through FIG. 20B show a third embodiment of the invention, wherein FIGS. 15A, 17A, 18A, 19A and 20A are longitudinally sectioned view of the pencil of the third embodiment showing the structural feature and an operational mode thereof, and FIGS. 15B, 17B 17C, 18B, 19B and 20B show diagramatically the operation of the major parts and elements of the pencil shown in FIG. 15A, and FIG. 21A through FIG. 24B show a fourth embodiment of the invention, wherein

DETAILED DESCRIPTION OF THE PREFERRED EMBODIMENTS

Figure 1A:
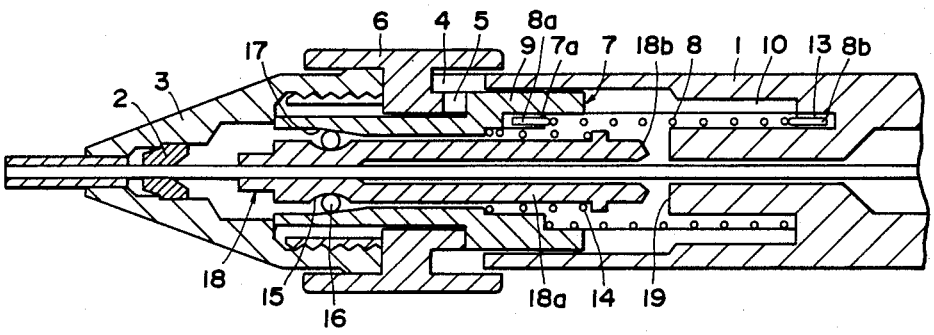
Figure 5A:
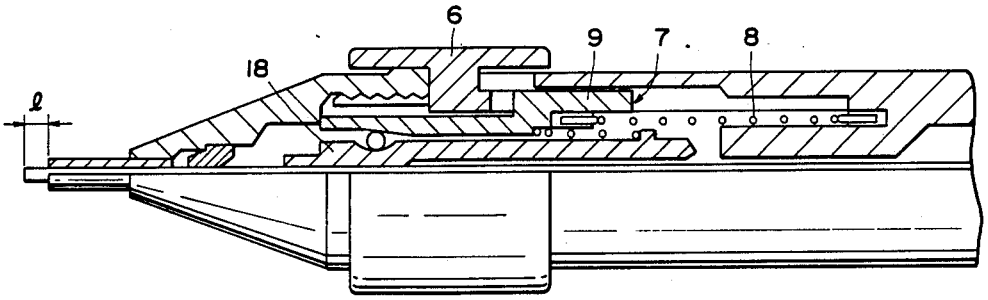
Figure 5B:
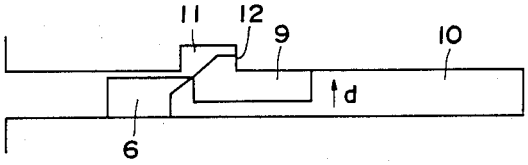
Figure 6:
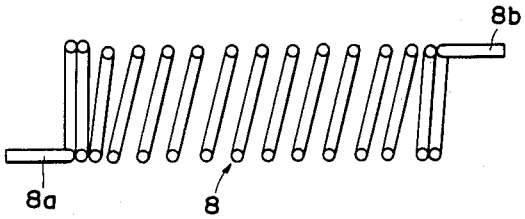
FIG. 6 is a longitudinal sectional view of a coil spring which biases a chuck actuator both in a forward direction and in a rotational or circumferential direction.
Figure 7:
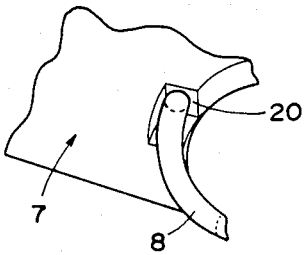
FIG. 7 is a perspective view of an anchor portion of a coil spring in a modified structure.
Figure 8:
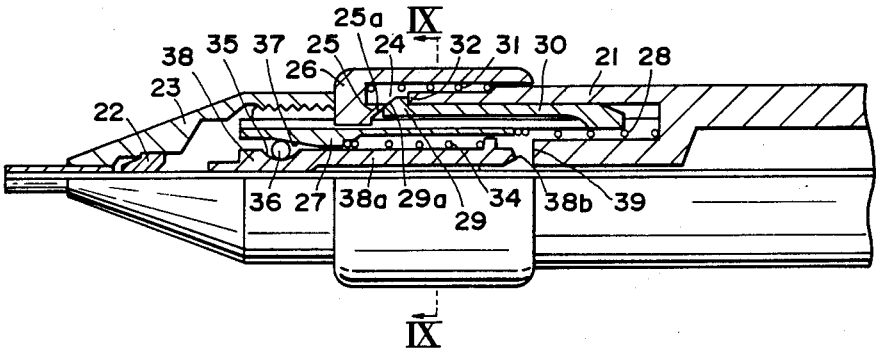
Figure 9:
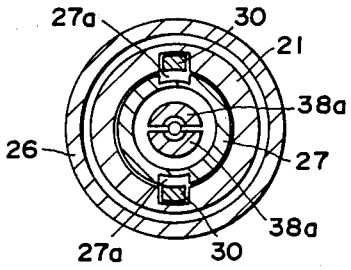

Referring fist to FIGS. 1A–6, a mechanical pencil has a barrel or a tubular casing 1 and a conical tip piece 3 having a lead retainer ring 2 mounted therein. As illustrated, the conical tip 3 is threadedly engaged with the tubular casing in an ordinary manner. The tubular casing 1 has a longitudinal slot 4 through which two paws 5 of an actuator tube 6 is longitudinally slidably projected for imparting an actuation force onto a chuck actuator 7, which will be described presently. The paws 5 are formed integral with the actuator tube 6 and projected radially inwardly from an inner surface of the tube 6, and each of the paws has an inclined portion 5*a* for slidably engaging an inclined portion of the chuck actuator 7. The chuck actuator 7 is longitudinally movably mounted within the tubular casing 1 between the tubular casing 1 and a chuck device 18 in a known manner as in the conventional mechanical pencil. The chuck actuator 7 has a groove 7*a* for anchoring one end of a coil spring 8, the other end of which is anchored in a groove 13 of a tubular casing 1 as illustrated in FIG. 1A. The chuck actuator 7 is biased in a forward direction toward the writing tip and in a circumferential direction by the coil spring 8. In the present invention, the chuck actuator 7 has an engagement portion 9 having an inclined portion 9*a* which contacts in a confronting relation the inclined surface 5*a* of the paw 5, and the engagement portion 9 is movably positioned in a longitudinal recess 10 formed on an inner surface of the tubular casing 1 so that it contacts a stopper 12 formed by an end of the recess 10. The inclined surfaces 9*a* and 5*a* are formed such that the engagement portion 9 (chuck actuation device 7) can be pivoted or moved circumferentially when the inclined surface 5*a* is moved to abut against the inclined surface 9*a*. The chuck actuator 7 is spring-biased by a coil spring 8 in the forward direction toward the lead retainer 2 in a normal state, and the inclined surface 9*a* of the chuck actuator 7 is spring-biased and positioned at a shoulder 11 to contact the inclined surface of the paw 5. As illustrated in FIG. 6, the coil spring 8 is twisted and installed such that its one end 8*a* is anchored at a hole 13 and the other 8*b* at a groove 7*a*. In FIG. 1A, reference numeral 18 represents a chuck device 18 which is spring-biased rearwardly toward an end cap (not shown) by a chuck spring 14 with rotary elements such as balls 16 being rotatably engaged between the inclined guide surface 17 of the chuck actuator 7 and a seat 15 so that the chuck device 18 can be opened and closed by the axial movement of the chuck device 18 relative to the chuck actuator 7 or vice versa. In the illustrated embodiment, the chuck device is made of a pair of chuck leaves 18*a* pivotably connected at a pivot (not shown) so that the forward end portion of the chuck leaves can be opened at the pivot when an inclined surface 18*b* of the rear end of the chuck device 18 contacts a stopper 19 portion which is formed inside the tubular casing. Alternatively, however, the chuck device can be a general type of known chuck structure which has a slit at the forward end thereof to impart an opening/closing force to the forward end portion. Any other types of chuck device can be used so far as it permits a forward movement of same, and has a structure such that its forward end is opened when it is moved forward relative to the chuck actuator 7.

An operation of the writing lead projection will be described with reference to FIGS. 1A to 5B.

Figure 1B:
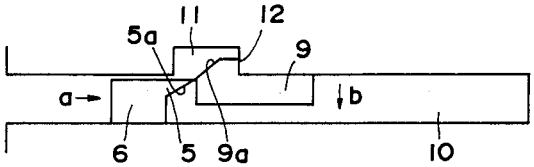
Figure 1C:
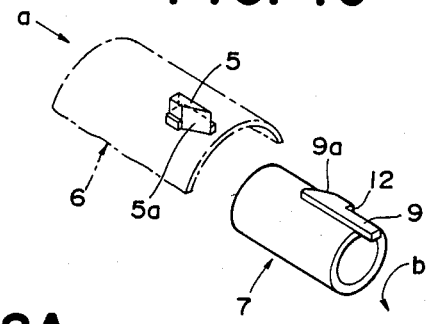
Figure 2A:
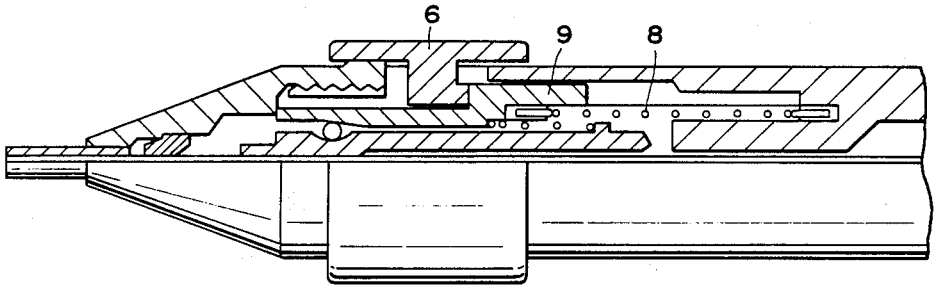
Figure 2B:
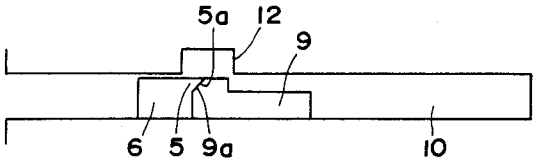
Figure 3A:
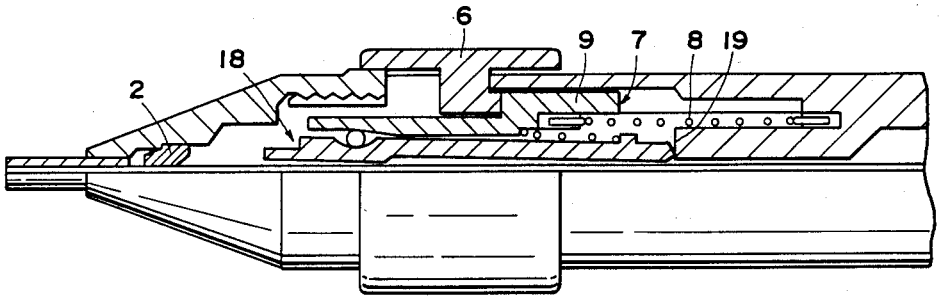
Figure 3B:
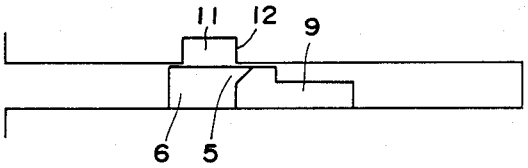

When the actuator tube or knob 6 is moved rearwardly by a fingertip operation as in the direction a in FIGS. 1B and 1C, the inclined surface 5*a* of the actuator tube 6 contacts the inclined portion 9*a* of the engagement portion 9 of the chuck actuator 7, and the chuck actuator is pivoted or moved circumferentially in the direction b in FIG. 1B against the rotary force of the coil spring 8 until it contacts the end of groove 10. By the pivotal movement of the chuck actuator 7, the engagement between the engagement portion 9 and the stopper 12 is released as shown in FIGS. 2A and 2B. Then, the engagement portion 9 of the chuck actuator 7 is still contacted with the paw 5 of the actuator tube 6 and moved in the rearward direction along the groove 10 together with the actuator tube 6 until the rear end of the chuck actuator 18 abuts against the stopper portion 19 of the tubular casing 1. A further rearward movement of the chuck actuator 7 is prevented by the stopper portion 19, and when the chuck device is further pushed rearwardly, the front end of the chuck device 18 projects forward from the chuck actuator 7 and opened as illustrated in FIG. 3A. At this moment, the writing lead is held in position by a grasping force of the lead retainer 2.

Figure 4A:
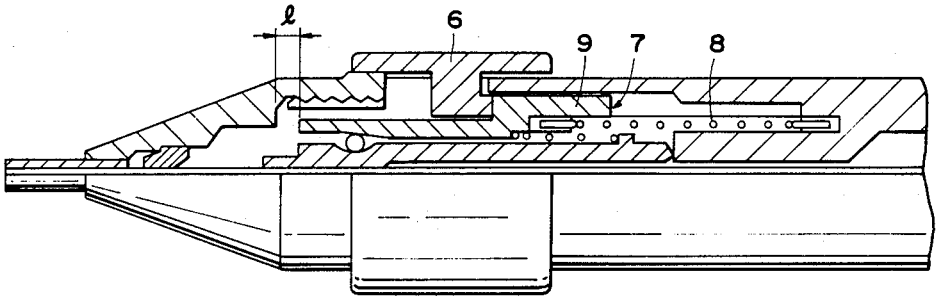
Figure 4B:
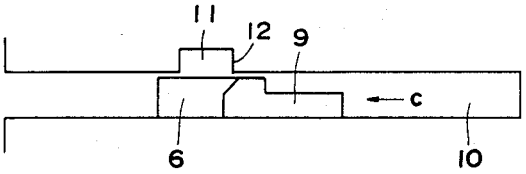

When the pressure added to the actuator tube 6 is released, the tube 6 and the chuck actuator 7 are advanced or moved in the forward direction toward the lead retainer 2 by a resilient force of the coil spring 8 in the direction of c in FIG. 4B. Since the chuck actuator 7 generally receives a rotary force by the coil spring 8, when the engagement portion 9 of the chuck actuator 7 is returned to the positon of the shoulder 11 as shown by arrow d in FIG. 5B, the engagement portion 9 of the chuck actuator 7 engages again the stopper 12, and in this returning process, the writing lead which has been held firmly by the chuck device 18 is advanced together with the chuck device, with the result that the writing lead is advanced by the length of "l", as shown in FIG. 5A, the length "l" being equal to the retracting distance "l" of the chuck actuator 7 shown in FIG. 4A. By adjusting the distance of the rearward movement of the actuator tube or knob 6 rather than the fully forward movement of same as described above, a suitable length of projection of the writing lead can be selected.

In the illustrated embodiment, although the coil spring 8 is anchored at the groove 7*a* of the chuck actuator 7 as shown in FIG. 1A, an offset 20 can be formed on the outer surface of the chuck actuator 7 for receiving the end of the coil spring 8 so far as the spring 8 can bias the chuck actuator in the rotational direction, that is, toward the shoulder 11. Further, although two engagement portions 9 are shown in FIG. 1A, one of them can be omitted.

With reference to FIGS. 8 through 13 showing a second embodiment of the invention, a tubular casing 21 has at its forward end portion a conical tip member 21 having therein a known lead retainer 22, and two logitudinal slots 24 through which paws 25 of an actuator tube 26 or a knob extend slidably. The actuator tube 26 is spring-biased in the forward direction by the coil spring 31. The paws 29 are formed in a similar configuration and, therefore, one of them will be explained. The paw 29 extends from an inner surface of the actuator tube 26 and has an inclined surface 25*a*. A chuck actuator 27 is spring-biased in the forward direction by a spring 28 and has grooves 27*a* on the opposite outer surface and engagement levers 30 which extend along the length of the chuck actuator 27 and are inwardly deflectable. The engagement lever 30 has an inclined surface 29*a* at a confronting relation with the inclined surface of the paw 29 of the tubular actuator knob 26. In a normal condition, the chuck actuator 27 is forwardly spring-biased by the spring 28, and the engagement portion 29 is positioned at the slot 24 so that the inclined surface 29*a* of the engagement lever 29 is contacted with the inclined surface of the paw 25, and when the actuator knob 26 is moved rearwardly, the engagement between the engagement portion 29 and the stopper 32 is released by the inward deflection, or resilient movement, of the engagement lever 30 due to the pressure added on the inclined surface 29*a* of the engagement lever 30 by the rearward movement of the actuator knob 26. Thus, the actuator knob 26 and the chuck actuator 27 are moved at the same time. Inside the chuck actuator 27 is disposed a chuck device 38 which is spring-biased rearwardly by a chuck spring 34 with rotary elements such as balls 36 being rotatably disposed between the inclined inner surface 37 of the chuck actuator 27 and a seat 35 of the forward end portion of the chuck device 38.

An operation of the pencil according to the second embodiment will be explained.

Figure 10:
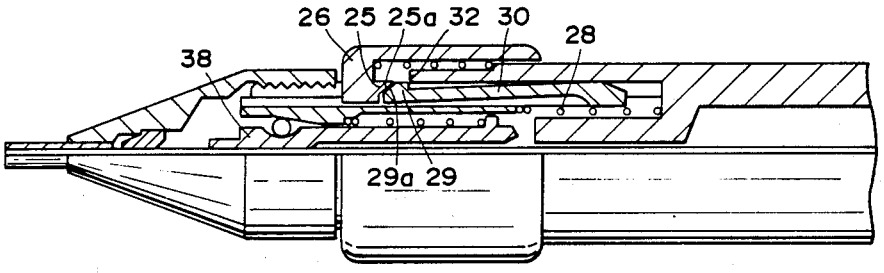
Figure 11:
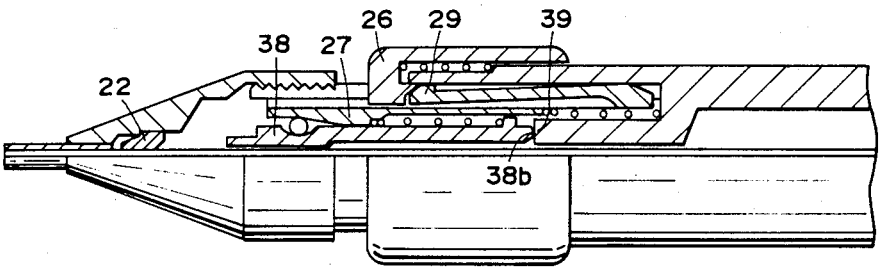

When the actuator knob 26 is moved rearwardly against a resilient force of the spring 31, the inclined surface 29*a* of the engagement lever 30 receives a rearward thrust by a contact with the inclined surface 25*a* of the paw 25 of the actuator tube 26 to resiliently deflect inwardly the engagement lever 30, with the result that the engagement between the stopper 32 and the engagement portion 29, as illustrated in FIG. 10. The inwardly pushed engagement lever 29 is still contacted with the paw 25 and moved in the rearward direction along with the actuator tube 26 against a resilient force of the spring 28. When chuck actuator 38 is moved further after the rear end of the chuck device 38 contacts the stopper portion 39 of the tubular casing 21, the chuck device 38 is projected forwardly from the chuck actuator 27 and opened to release the lead-grasping force, as illustrated in FIG. 11. At this moment, the writing lead is held in position by the lead retainer 22.

Figure 12:
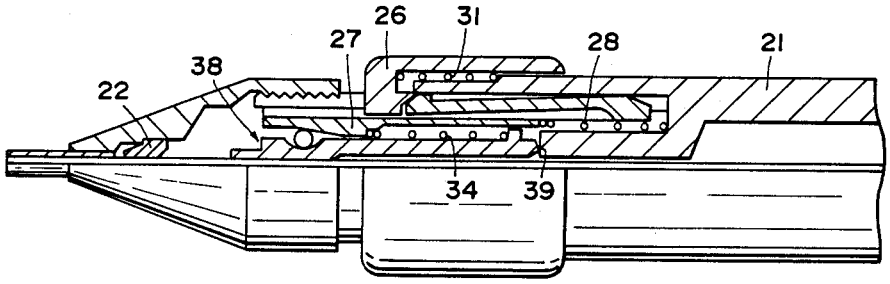
Figure 13:
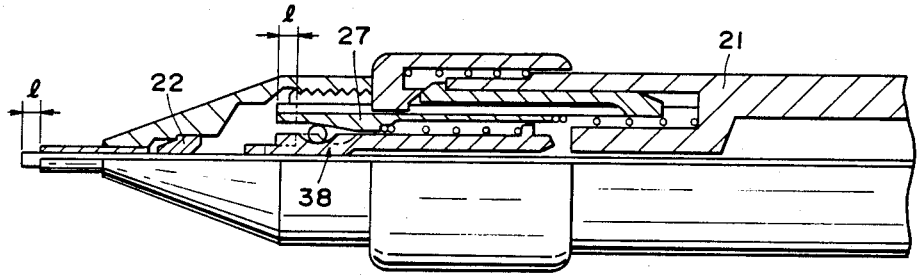

When the pressure added to the actuator tube 26 is released, the actuator tube 26 and the chuck actuator 27 are advanced by the resilient forces of the springs 31 and 28, respectively, and the chuck device 38 is released from the stopper portion 39 and then returned to the original position by means of the chuck spring 34 to close the forward end portion to firmly hold again the writing lead, as shown in FIG. 12. From the position shown in FIG. 12, the actuator tube or knob 26 and the chuck actuator 27 are moved further in the forward direction to their original position, and during this movement, the writing lead is advanced by the length of "l" along with the chuck device 13 since the writing lead is grasped by the chuck device, as shown in FIG. 13.

Figure 14:
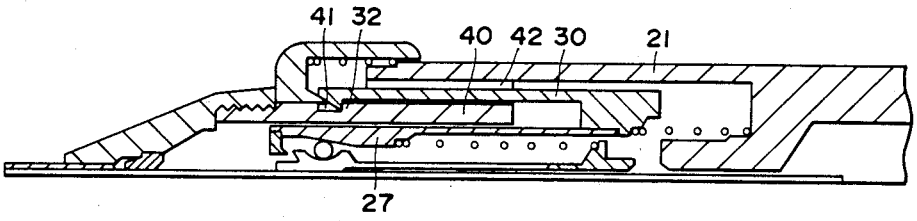
FIG. 14 is a sectional view of the major parts of elements in a further modified structure of the second embodiment.
Figure 15A:
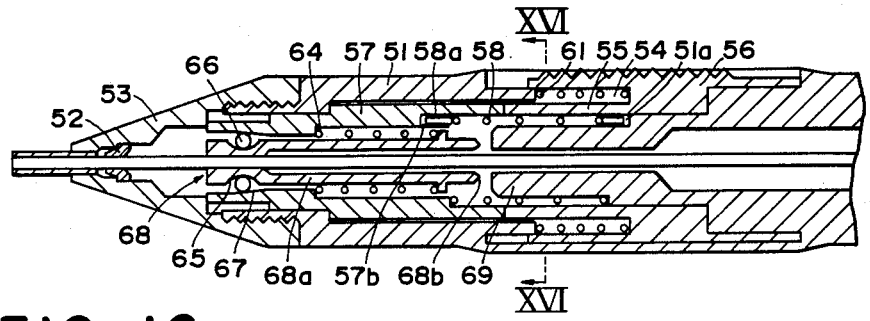

In the illustrated embodiment, the stopper 32 consists of an end of the slot 24 of the tubular casing 21. However, as illustrated in FIG. 14, the stopper 32 can be formed of a shoulder of a groove 41 which is formed on the outer surface of the tubular portion 40 of the tubular casing 21. In the embodiment of FIG. 14, the engagement lever 30 of the chuck actuator 27 is inserted into a hole 42 formed between the tubular casing 21 and the tubular portion 40 so that the lever 30 can be deflected outwardly. Although two engagement levers 30 and two engagement portions 29 are shown (FIG. 9),one of the levers 30 and one of the portions 29 can be omitted.

Figure 16:
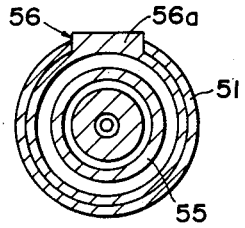

With reference to FIGS. 15A to 20B, showing a third embodiment of the invention, a tubular casing 51 has a conical tip 53 having therein a known lead retainer 52. The tubular casing 51 has longitudinal slots 54 for longitudinally sladably receiving a knob portion 56*a* of an actuator knob 56 which is rearwardly spring-biased by a spring 61. The actuator knob 56 has an inclined surface 55*a* and a paw 55 forming an engagement recess 55*b* which engages an engagement portion 57*a* of a chuck actuator 57. In the embodiment of FIG. 16, only a part 56*a* of the knob 56 is extended from the tubular casing 51, but the knob itself can be formed into a tubular structure so that all the outer surface of the tubular knob 56 is exposed and slidable along the outer surface of the tubular casing 51. Reference numeral 61 represents a coil spring which biases the actuator knob 56 rearwardly and reference numeral 58 is a coil spring which has an end 58*a* anchored at the groove 57*b* and the other end anchored at a recess 51*a* of the tubular casing 51. The spring 61 has a stronger resilient force than the spring 58. The chuck actuator 57 is spring-biased in the forward direction by the spring 58 and receives a rotational force of the spring 58 as similar as the previous embodiments. Thus, the chuck actuator 57 is spring-biased in the forward and circumferential directions. The chuck actuator 57 has at its outer surface an engagement portion 57*b* having an inclined surface 57*a* and a locking portion 59 which engages a stopper 62 formed with an end of a groove 63. The groove 63 is formed on an inner surface of the tubular casing 51. The tubular casing 51 has a portion which functions to release the engagement between the engagement portion 57*a* and the engagement recess 55.

The inclined surface 55*a* and 57*a* are designed so that when the inclined surface 55*a* of the knob 56 is advanced toward the writing tip to push the inclined surface 57*a* of the chuck actuator 57, the engagement portion 59 of the chuck actuator 57 can be pivoted. Inside the chuck actuator, a chuck device 68 is spring-biased in the rearward direction by the chuck spring 64 so that the open end of the chuck device 68 is generally closed by the effect of rotary elements 66 such as balls 66 received between an inclined guide surface 67 and a ball seat 65. The chuck device 68 consisits of a pair of chuck leaves 68*a* each of which has an inclined surface at their rear ends and which are arranged in an opposed relation so that they are pivoted with each other at their pivot points (not shown) to be opened at their front end portion to release a writing lead grasping force when the inclined surface 68*b* of the rear end is pressed against the stopper portion 69.

An operation of the pencil according to the third embodiment of the invention will be described.

Figure 15B:
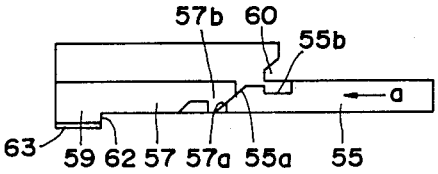
Figure 17A:
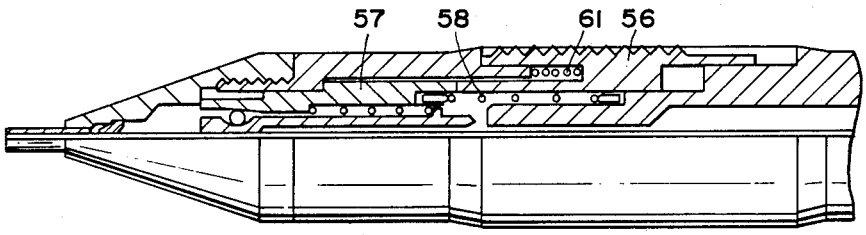
Figure 17B:
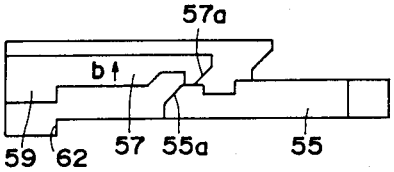
Figure 17C:
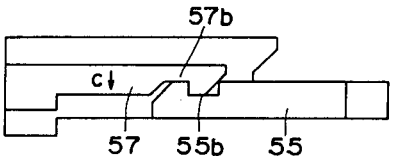
Figure 18A:
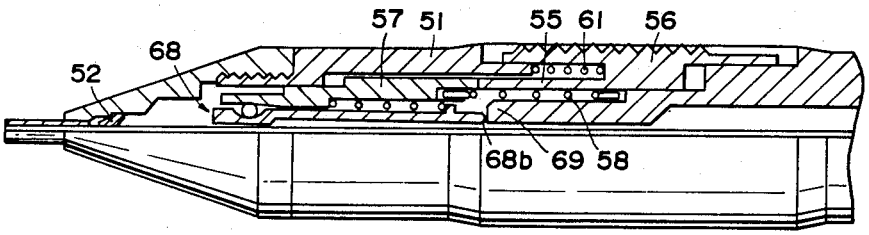
Figure 18B:
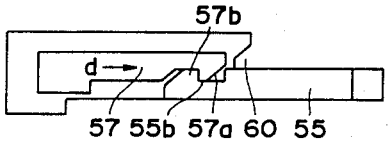
Figure 19A:
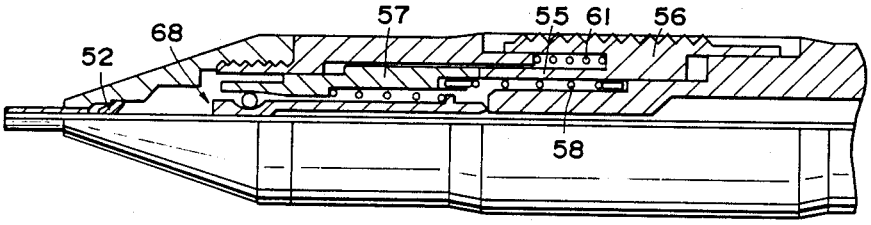
Figure 19B:
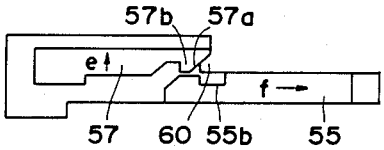
Figure 20A:
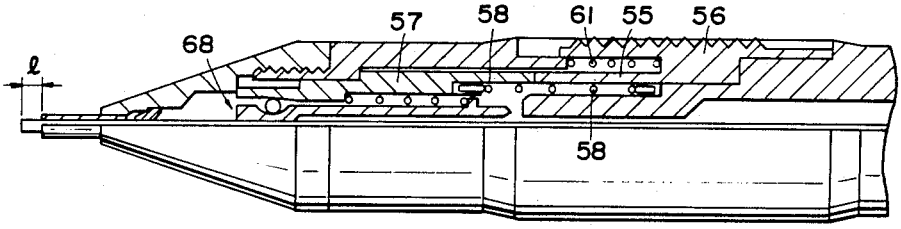
Figure 20B:
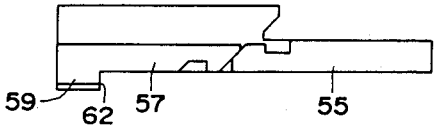

When the knob 56 is moved forward in the direction shown by an arrow a in FIG. 15B, the inclined surface 55*a* of the knob 56 pushes the inclined surface 57*a* of the chuck actuator 57 to forcibly rotate the chuck actuator 57 against a resilient force of the spring 58 as shown by an arrow b in FIG. 17B. When the knob 56 is moved further, the engagement portion 55*b* of the chuck actuator 57 is engaged with the engagement recess 55*b* of the paw 55 of the knob 56, as shown by an arrow in FIG. 17C. Then, when the pressure added to the knob is released (FIG. 18A), both the chuck actuator 57 and the knob 56 are moved in the rearward direction by a resilient force of the spring 61 as shown by an arrow d in FIG. 18B. Since the chuck actuator 68 is moved rearwardly after its rear end inclined surface 68*b* contacts the stopper portion 69 of the tubular casing, the chuck device 68 is projected forward from the chuck actuator 57 and is opened to release its lead-grasping force. At this moment, the writing lead is held in position by a lead-grasping force of the lead retainer 52. The rearwardly moved chuck actuator 57 contacts the tapered projection 60 of the tubular casing 51 to stop its movement, and yet the knob 56 is moved further in the rearward direction as shown by an arrow f of FIG. 19B, and thus the inclined surface 57*a* of the chuck actuator 57 moves along the tapered projection 60 as shown by an arrow e in FIG. 19B so that the engagement between the engagement portion 57*b* of the chuck actuator 57 and the engagement recess 55*b* of the knob 56 is released, as shown in FIGS. 19A and 19B. The released chuck actuator 57 is moved in the forward direction toward the writing tip by a resilient force of the spring 58. Since the chuck actuator always receives a rotational force of the spring 58, the engagement portion 59 of the chuck actuator 57 is engaged with the recess 62 of the groove 63 and the chuck actuator is returned to their original position shown in FIGS. 15A and 15B. In this returning step, the chuck device 68 holds the writing lead firmly and, accordingly, the writing lead is advanced together with the chuck device 68, with the result that the writing lead is projected by the length of "l" as illustrated in FIG. 20A.

A modified structure of the pencil according to the fourth embodiment of the invention will be described.

Figure 21A:
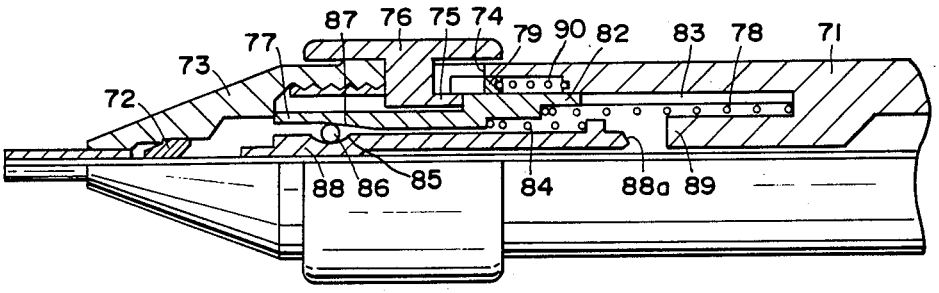
FIGS. 21A, 22A, 23A and 24A show structural features of the pencil in the fourth embodiment.
Figure 21B:
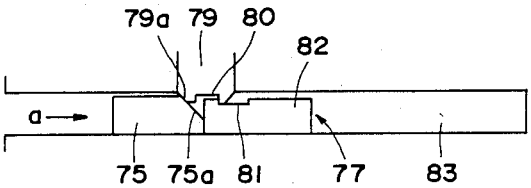
FIGS. 21B, 22B, 23B and 24B show the operation of the major parts and elements of the pencil shown in FIG. 21A.

In FIGS. 21A and 21B, a tubular casing 71 has a conical tip member 73 having a lead retainer 72 and two longitudinal slots 74, only one of which is shown and described for simplification, for longitudinally movably receiving therethrough an actuator tube or knob 76. The knob 76 has a paw 75 having an inclined surface 75*a*. The chuck actuator 77 is forwardly spring-biased by the spring 78 and provided with an engagement portion 82 having an engagement groove 81 which portion 82 contacts the paw 75 of the knob 76 and is generally engaged with a groove 80 of a rotary ring 79 which will be described presently. The engagement portion 82 is movably located in a groove 83 formed on an inner surface of the tubular casing 71. The rotary ring 79 receives a rotational force of the spring 78 and rotatably positioned inside the tubular casing 71. The rotary ring 79 has an inclined surface 79*a* which will contact the inclined surface 75*a* of the paw 75, and a groove 80 which engages with the engagement groove 81 of the chuck actuator 77. Inside the chuck actuator 77 is disposed a chuck device 88 which is rearwardly spring-biased by the spring 84 and has a rotary elements such as balls 86 rotatably secured between a seat 85 and a inclined guide surface 87 to the chuck actuator 77 so that the chuck head can be opened to release a lead-grasping force and closed to firmly grasp the writing lead by a longitudinal movement of the chuck device relative to the chuck actuator.

An operation of the pencil of the fourth embodiment will be described.

Figure 22A:
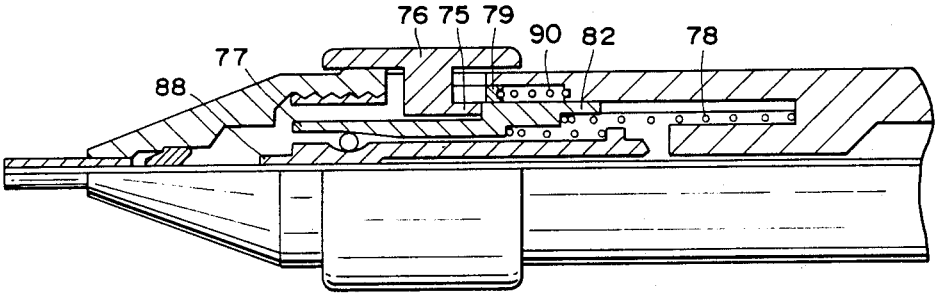
Figure 22B:
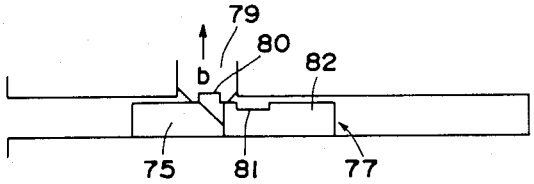
Figure 23A:
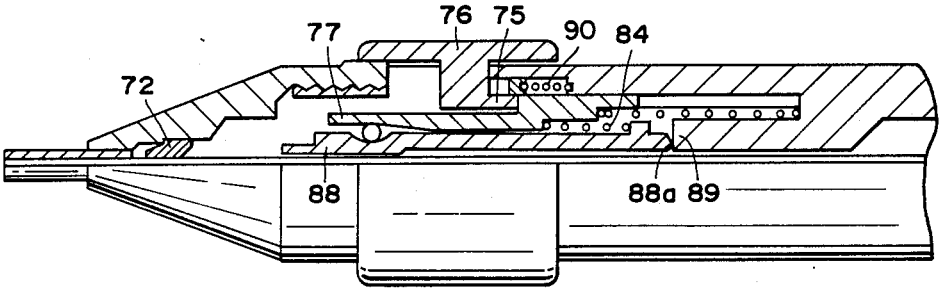
Figure 23B:
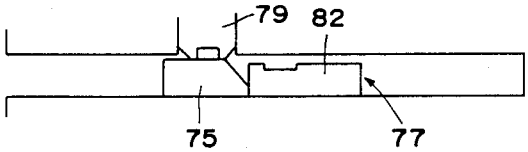
Figure 24A:
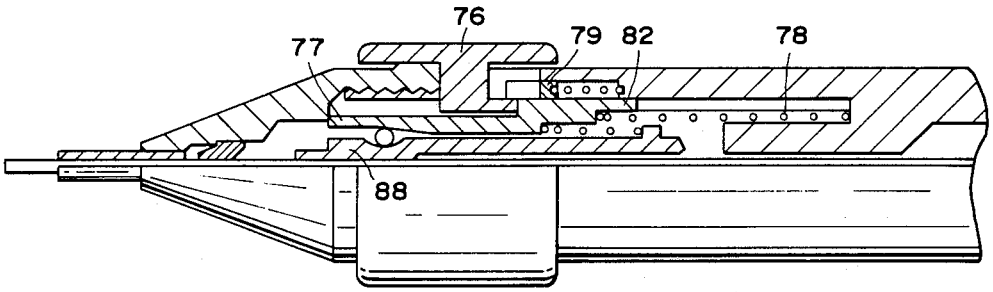
Figure 24B:
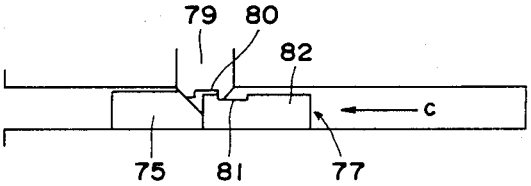

When the knob 76 is moved rearwardly as shown by an arrow a in FIG. 21B, the inclined surface 79*b* of the rotary ring 79 moves along the inclined surface 75*a* of the paw 75 of the knob 76, with the result that the rotary ring 79 is rotated in the direction of arrow b in FIG. 22B against a rotational force of the spring 78. At this moment, the engagement between the engagement groove 81 of the chuck actuator 77 and the groove 80 of the rotary ring 79 is released. Then, the knob 76 is movable together with the chuck actuator 77 until it contacts the end of the longitudinal slot 74. By this movement, an inclined portion 88*a* of the rear end of the chuck device 88 contacts the stopper portion 89 of the tubular casing 71 to restrict a further rearward movement of the chuck device 77. Thus, the chuck device 88 is projected forwardly from the chuck actuator 77 to thereby open the chuck head to release the lead-gripping force (FIGS. 23A and 23B). At this moment, the writing lead is held in the position by the lead retainer 72. When the force added to the knob 76 is released, both the knob 76 and the chuck actuator 77 are moved forward by the spring force of the spring 78 as shown by an arrow c in FIG. 24B. When the engagement groove 81 of the chuck actuator 77 reaches the position of the engagement groove 80 of the rotary ring 79, the rotary ring 79 which was spring-biased in the rotational direction by the spring 79 is returned to the position of FIGS. 21A and 21B. In this returning step, the writing lead which has been grasped by the chuck device is moved in the forward direction together with the chuck device 88, with the result that the writing lead is projected by the length of "l" as shown in FIG. 24A.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention will not be limited to the particular embodiment illustrated by the drawings contemplated for carrying out the present embodiments falling within the description of the appended claims.

What is claimed is:

1. A mechanical pencil comprising:

a tubular casing;

a centrally apertured conical tip piece connected to an end of said tubular casing to form a pencil tip and having a lead retainer for frictionally holding the lead therein;

a lead engaging chuck device longitudinally movably mounted within the tubular casing to grasp the writing lead;

a chuck actuator longitudinally movably mounted within said tubular casing:

first spring means for biasing said chuck device rearwardly relative to said chuck actuator;

second spring means for biasing said chuck actuator forwardly and circumferentially relative to said tubular casing;

actuation knob means, longutudinally movably mounted on said tubular casing, for circumferentially rotating said chuck actuator against a force of said second spring means;

engagement means for slidably engaging said chuck actuator to said actuation knob to rotate said chuck actuator against a force of said second spring means; and locking means for locking said chuck actuator to prevent a further rotation of said chuck actuator to thereby release the engagement between said actuation knob and said chuck actuator;

whereby when the engagement between said actuation knob and said chuck actuator is released, said chuck device and said chuck actuator are moved rearwardly together with said actuation knob against a resilient force of said second spring means until said chuck contacts a portion of said tubular casing.

2. A mechanical pencil according to claim 1, wherein said chuck actuator comprises a projection on its outer surface and said engagement means comprises a groove formed on said tubular casing for holding said projection of the chuck actuator.

3. A mechanical pencil according to claim 1, wherein said chuck actuator comprises a resilient lever inwardly deflectably formed on an outer surface thereof, and said engagement means comprises a longitudinal slot to form a stopper at its rear end to thereby engage with said resilient lever.

4. A mechanical pencil according to claim 1, wherein said chuck actuator comprises a resilient lever outwardly deflectably formed on an outer surface thereof, and said engagement means comprises a recess to form a stopper at its rear end to thereby engage with said resilient lever.

5. A mechanical pencil comprising:

a tubular casing;

a centrally apertured conical tip piece connected to an end of said tubular casing to form a pencil tip and having a lead retainer for frictionally holding the writing lead therein;

a lead engaging chuck device longitudinally movably mounted within said tubular casing to grasp the writing lead;

a chuck actuator longitudinally movably mounted within said tubular casing;

first spring means for biasing said chuck device rearwardly relative to said chuck actuator;

second spring means for biasing said chuck actuator forwardly relative to said tubular casing;

a rotary ring rotatably mounted around said chuck actuator;

said rotary ring being rotationally spring-biased by said second spring means, said rotary ring having an inclined surface and being engageable with said chuck actuator, actuation knob means, longitudinally movably mounted on said tubular casing, and coactable with said inclined surface of said rotary ring to release the engagement between said rotary ring and said chuck actuator;

whereby when said rotary ring is pivoted by actuation of said actuation knob means against a rotational force of said second spring means, the engagement between said chuck actuator end said rotary ring is released so that said chuck device and said chuck actuator are moved rearwardly together with said actuation knob means against a resilient force of said second spring until said chuck device contacts a portion of said tubular casing, and whereby a further rearward movement of said actuation knob means permits projection of said chuck device forward from said chuck actuator to thereby release a lead gripping force of said chuck device.

* * * * *

UNITED STATES PATENT AND TRADEMARK OFFICE

CERTIFICATE OF CORRECTION

PATENT NO. : 4,884,911

DATED : December 5, 1989

INVENTOR(S) : Hideaki OIKAWA

It is certified that error appears in the above-identified patent and that said Letters Patent is hereby corrected as shown below:

```
Column  4, line  6, change "6" to --1A--;
           line  7, change "hole 13" to --groove 7a--;
           line  8, change "groove 7a" to --hole 13--;
           line 48, change "actuator" to --device--;
           line 50, change "actuator 7" to --device
                    18--;
           line 51, change "device" to --actuator 7--;
Column  5, line  2, change "1" to --ℓ--;
           lines 3 and 4, change "1" to --ℓ--;
           line 20, change "21" to --23--;
           line 25, change "29" to --25--;
           line 27, change "29" to --25--;
           line 35, change "29" to --25--;
           line 42, change "the" (second occurrence) to
                    --a--;
           line 68, change "38" to --27--;
Column  6, line 19, change "1" to --ℓ--; change "13" to
                    --38--;
           line 26, change "the" (second occurrence) to
                    --a--;
           line 66, change "55" to --55b--;
Column  7, line 25, change "55b" to --57b--;
           line 34, change "the" (first occurrence)
                    --a--;
           line 60, change "1" to --ℓ--;
```

UNITED STATES PATENT AND TRADEMARK OFFICE

CERTIFICATE OF CORRECTION

PATENT NO. : 4,884,911

DATED : December 5, 1989

INVENTOR(S) : Hideaki OIKAWA

It is certified that error appears in the above-identified patent and that said Letters Patent is hereby corrected as shown below:

```
Column  8, line  2, change "the" to --a--;
           line  9, change "78" to --90--;
           line 26, change "79b" to --79a--;
           line 30, change "78" to --90--;
           line 39, change "77" to --88--;
           line 56, change "1" to --ℓ--;
Column 10, line 38, change "end" to --and--;
```

Signed and Sealed this

Twenty-ninth Day of January, 1991

*Attest:*

*Attesting Officer*

HARRY F. MANBECK, JR.

*Commissioner of Patents and Trademarks*